US009870727B2

(12) United States Patent
Lee

(10) Patent No.: US 9,870,727 B2
(45) Date of Patent: Jan. 16, 2018

(54) DISPLAY DEVICE AND DRIVING METHOD THEREOF

(71) Applicant: SAMSUNG DISPLAY CO., LTD., Yongin, Gyeonggi-Do (KR)

(72) Inventor: Min-Tak Lee, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 51 days.

(21) Appl. No.: 14/701,411

(22) Filed: Apr. 30, 2015

(65) Prior Publication Data

US 2016/0155416 A1 Jun. 2, 2016

(30) Foreign Application Priority Data

Nov. 28, 2014 (KR) ..... 10-2014-0169124

(51) Int. Cl.
*G09G 3/20* (2006.01)
*G09G 5/20* (2006.01)

(52) U.S. Cl.
CPC ..... *G09G 3/2003* (2013.01); *G09G 5/20* (2013.01); *G09G 2300/0452* (2013.01); *G09G 2320/0242* (2013.01); *G09G 2340/0457* (2013.01); *G09G 2360/16* (2013.01)

(58) Field of Classification Search
CPC ..... G09G 2320/0242; G09G 2320/02; G09G 2320/0233; G09G 2320/0666; G09G 2300/0452; G09G 2300/0439; G09G 3/2003; G09G 3/3607; G09G 3/2007; G09G 3/2074; G09G 5/02; G09G 2320/04;

(Continued)

(56) References Cited

U.S. PATENT DOCUMENTS 6,897,876 B2 * 5/2005 Murdoch ..... G09G 3/3208 345/22
8,330,352 B2 * 12/2012 Sung ..... H01L 27/3216 313/504

(Continued)

FOREIGN PATENT DOCUMENTS

JP 2001-117529 A 4/2001
KR 10-0923053 B1 10/2009

(Continued)

*Primary Examiner* — Grant Sitta
*Assistant Examiner* — Amen Bogale
(74) *Attorney, Agent, or Firm* — Lewis Roca Rothgerber Christie LLP

(57) ABSTRACT

A display device includes: a display unit including pixels including a first color subpixel at a left upper end, a second color subpixel at a left lower end, and a third color subpixel at a right side; a data converter to convert first color, second color, and third color unit input data into first color, second color, and third color unit adapted data; and a driver to apply an image signal to the pixel based on the adapted data, the data converter generating unit adapted data using first unit input data of a target subpixel and second unit input data of another subpixel adjacent the target subpixel along a direction, the direction being: an up direction when the target subpixel is the first color subpixel; a down direction when the target subpixel is the second color subpixel; and a right direction when the target subpixel is the third color subpixel.

5 Claims, 9 Drawing Sheets

(58) Field of Classification Search
CPC ... G09G 2320/0646; G09G 2300/0465; G09G 3/2077; G09G 2340/06
See application file for complete search history.

(56) References Cited

U.S. PATENT DOCUMENTS

2001/0041000 A1* 11/2001 Okada ..... G09G 5/222 382/162
2002/0008714 A1* 1/2002 Tezuka ..... G09G 3/2003 345/694
2002/0015046 A1* 2/2002 Okada ..... G09G 5/24 345/613
2002/0135598 A1* 9/2002 Tezuka ..... G09G 3/2003 345/613
2003/0160805 A1* 8/2003 Toji ..... G09G 3/2003 345/694
2003/0222894 A1* 12/2003 Toji ..... G09G 5/02 345/694
2005/0062767 A1* 3/2005 Choe ..... G09G 3/3607 345/694
2005/0116906 A1* 6/2005 Goto ..... G09G 3/3208 345/76
2009/0309821 A1* 12/2009 Tanno ..... G02F 1/133514 345/87
2011/0128262 A1* 6/2011 Chaji ..... H01L 51/5271 345/205
2011/0242149 A1* 10/2011 Yoshida ..... G09G 3/3648 345/690
2011/0254759 A1* 10/2011 Mori ..... G09G 3/3607 345/88
2013/0241946 A1* 9/2013 Jeong ..... G09G 3/2074 345/589
2013/0321598 A1* 12/2013 Inoue ..... G09G 3/20 348/54
2014/0043369 A1* 2/2014 Albrecht ..... G09G 3/2074 345/690
2014/0092147 A1* 4/2014 Kimura ..... G09G 3/3426 345/690
2015/0356903 A1* 12/2015 Lee ..... G09G 3/2003 345/600
2016/0027369 A1* 1/2016 Guo ..... G09G 3/2003 345/694

FOREIGN PATENT DOCUMENTS

KR 10-2013-0074374 A 7/2013
KR 10-2013-0105145 A 9/2013

* cited by examiner 150
210
PX
230
210
PX
230
R
220
B
G
R
220
B
G
R
B
G
R
B
G
R (a)

(b)

R

| | | |
|---|---|---|
| 0 | 0 | 0 |
| 0 | 2/3 | 0 |
| 0 | 1/3 | 0 |

G

| | | |
|---|---|---|
| 0 | 1/3 | 0 |
| 0 | 2/3 | 0 |
| 0 | 0 | 0 |

B

| | | |
|---|---|---|
| 0 | 0 | 0 |
| 0 | 2/3 | 1/3 |
| 0 | 0 | 0 |

(a)

(b)

R

| | | |
|---|---|---|
| 0 | 0 | 0 |
| 0 | 2/3 | 0 |
| 0 | 1/3 | 0 |

G

| | | |
|---|---|---|
| 0 | 1/3 | 0 |
| 0 | 2/3 | 0 |
| 0 | 0 | 0 |

B

| | | |
|---|---|---|
| 0 | 0 | 0 |
| 1/3 | 2/3 | 0 |
| 0 | 0 | 0 |

(a)

(b)

R

| | | |
|---|---|---|
| 0 | 0 | 0 |
| 1/3 | 2/3 | 0 |
| 0 | 0 | 0 |

G

| | | |
|---|---|---|
| 0 | 0 | 0 |
| 0 | 1 | 0 |
| 0 | 0 | 0 |

B

| | | |
|---|---|---|
| 0 | 0 | 0 |
| 0 | 2/3 | 1/3 |
| 0 | 0 | 0 |

DISPLAY DEVICE AND DRIVING METHOD THEREOF

CROSS-REFERENCE TO RELATED APPLICATION

This application claims priority to and the benefit of Korean Patent Application No. 10-2014-0169124 filed in the Korean Intellectual Property Office on Nov. 28, 2014, the entire contents of which are incorporated herein by reference.

BACKGROUND

1. Field

Aspects of embodiments of present invention relate to a display device and a driving method thereof, and more particularly, to a rendering technique of a display device having an S-stripe pixel structure.

2. Description of the Related Art

An image display device includes a display unit including a plurality of pixels. Each pixel generally includes red, green, and blue subpixels.

Various types of arrangement methods of the subpixels are disclosed. Representative examples of the arrangement methods of the subpixels include an RGB (red, blue, green) stripe method, in which rectangles having the same size are sequentially arranged, an RGBW (red, blue, green, white) method in which W (white) subpixels are further disposed in the RGB stripe method, and a pentile method in which subpixels RG (red, green) and GB (green, blue) are repeatedly arranged.

The subpixel configures one of the three primary colors, and emits light with an intensity (e.g., a predetermined intensity) according to an image desired to be displayed. A desired image is displayed according to an intensity of light emission and a position of a subpixel.

However, an undesired effect, such as color bleeding, may occur when some types of images (e.g., a specific image) are displayed due to the disposition of the regularly arranged subpixels.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention have been made in an effort to provide an image display device adopting an S-stripe form, which is capable of decreasing a color bleeding phenomenon at a boundary part (e.g., edges) within an image, and a driving method thereof.

An exemplary embodiment of the present invention provides a display device, including: a display unit including a plurality of pixels, each of the pixels including a first color subpixel at a left upper end, a second color subpixel at a left lower end, and a third color subpixel at a right side, which are arranged in an S-stripe form; a data converter configured to convert first color, second color, and third color unit input data portions of input data into first color, second color, and third color unit adapted data; and a driver configured to apply an image signal to the pixel based on the adapted data, wherein the data converter is configured to generate unit adapted data in accordance with first unit input data corresponding to a target subpixel and second unit input data corresponding to another subpixel adjacent to the target subpixel along a specific direction, the specific direction being: an up direction when the target subpixel is the first color subpixel; a down direction when the target subpixel is the second color subpixel; and a right direction when the target subpixel is the third color subpixel.

When a value of the first unit input data is Di1, a value of the second unit input data is Di2, and a value of the unit adapted data is Do, an equation below may be satisfied, $Do=a*Di1+(1-a)*Di2$, in this case, Di1, Di2, and Do may be data values of a luminance level, and a may be a real number within a range of $\frac{1}{2}<a<\frac{3}{4}$.

The value of a may be $\frac{2}{3}$.

The data converter may be configured to apply a rendering filter having a matrix equation as shown below to convert data corresponding to the first color subpixel, $$\begin{bmatrix} 0 & 1/3 & 0 \\ 0 & 2/3 & 0 \\ 0 & 0 & 0 \end{bmatrix},$$

apply a rendering filter having a matrix equation as shown below to convert data corresponding to the second color subpixel, and $$\begin{bmatrix} 0 & 0 & 0 \\ 0 & 2/3 & 0 \\ 0 & 1/3 & 0 \end{bmatrix}$$

apply a rendering filter having a matrix equation as shown below to convert data corresponding to the third color subpixel, $$\begin{bmatrix} 0 & 0 & 0 \\ 0 & 2/3 & 1/3 \\ 0 & 0 & 0 \end{bmatrix}.$$

The display device may further include a boundary detection unit, wherein when a difference between values of the unit input data corresponding to the plurality of adjacent subpixels is greater than or equal to a threshold value, the boundary detection unit detects the plurality of adjacent subpixels as a boundary part of an image, and wherein the data converter may be configured to convert only the input data corresponding to the boundary part of the adapted data.

According to the exemplary embodiments of the present invention, it is possible to provide an image display device adopting an S-stripe form, which is capable of decreasing a color bleeding phenomenon at a boundary part, and a driving method thereof.

DETAILED DESCRIPTION

Figure 1:
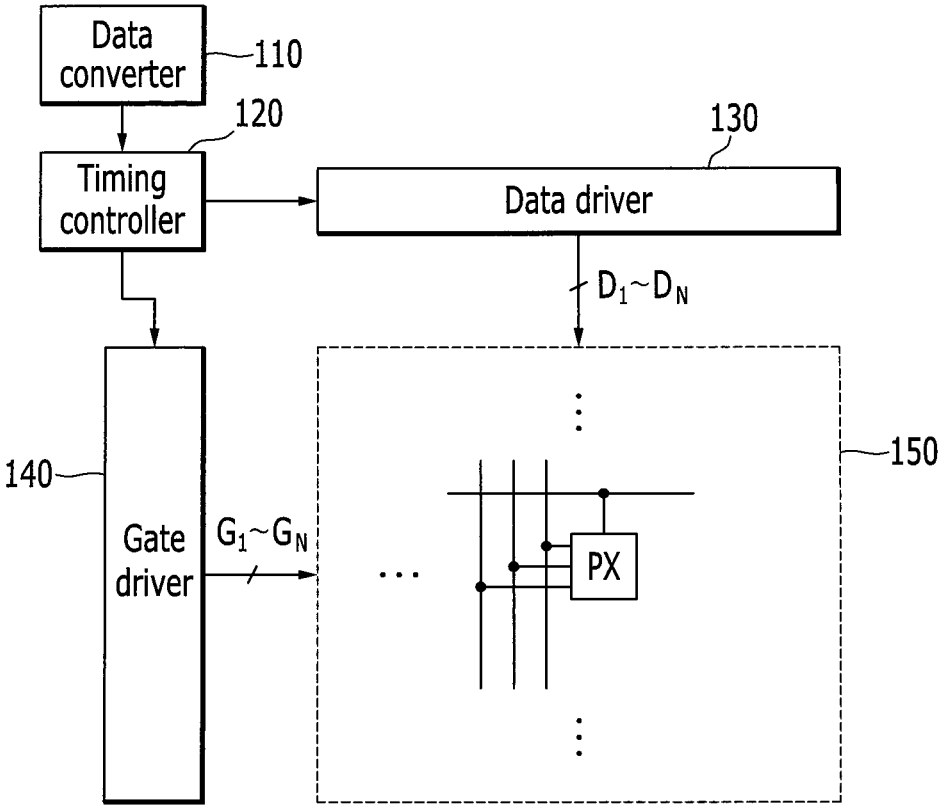
FIG. 1 is a diagram illustrating a configuration of a display device according to an exemplary embodiment of the present invention.

Exemplary embodiments of the present invention will be described in detail with reference to the accompanying drawings. In the following description and drawings, detailed explanation of known related functions and constitutions may be omitted when it is judged that the detailed description may make the subject matter of the present invention unclear. Further, like reference numerals designate like elements throughout the drawings.

Terms or words that are used in the present specification and claims to be described below should not be understood as general and lexical meaning, and should be understood as meanings and concepts that correspond to the technical spirit of the present invention in consideration of the principle that the concept of the term can be appropriately defined in order to describe the invention by using the best method by the inventor. Before this, the exemplary embodiment described in the present specification and the configuration illustrated in the drawing are simply the exemplary embodiments of the present invention, and do not represent all of the technical spirits of the present invention, and thus it should be understood that there are various equivalents and modification examples substitutable with the exemplary embodiment described in the present specification and the configuration illustrated in the drawing at the time of filing the present invention. Further, terms, such as "a first" and "a second", are used for describing various constituent elements, and are used for discriminating one constituent element from other constituent elements, but the constituent elements are not limited by the terms.

FIG. 1 is a diagram illustrating a configuration of a display device according to an exemplary embodiment of the present invention.

Referring to FIG. 1, a display device according to an exemplary embodiment of the present invention includes a data converter 110, a timing controller 120, a data driver 130, and a gate driver 140.

The display unit 150 may be one of any of a number of types of display units, such as a plasma display, a liquid crystal display, a light emitting diode (LED) display, and an organic light emitting diode (OLED) display, capable of outputting a still image or a video recognizable by a viewer.

The display unit 150 includes a plurality of pixels PXs arranged in a matrix form, and the pixels are controlled through data lines D1 to DN extending along a first direction from the data driver 130 and gate lines G1 to GN extended along a second direction from the gate driver 140, respectively. Although not illustrated in the drawings, other control lines may be included in the display unit.

In the present specification, for the sake of convenience, it is assumed that each pixel PX includes a first color subpixel, a second color subpixel, and a third color subpixel arranged in an S-stripe form.

Each subpixel may be connected with a separate control line, and selectively controlled. FIG. 1 illustrates that three data lines and one gate line are connected to one pixel PX, but this is illustrative, and may be variously designed according to a driving method desired to be implemented.

For example, two or three gate lines may be connected to the subpixels, respectively, and only one data line may be connected to the pixel and the subpixels may share the data line.

The data converter 110 converts input data applied from the outside (e.g., an external source) into adapted data, and provides the adapted data to the timing controller 120.

The data converter 110 may include a separate memory (not illustrated). The memory may store a lookup table of coefficients configuring a rendering filter.

The data converter 110 may include a boundary detection unit (not illustrated). When a difference in a gray value (or gray level) of data applied to the plurality of adjacent subpixels is equal to or greater than a threshold value (or a predetermined threshold value), the boundary detection unit may determine that the plurality of adjacent subpixels is a boundary part of an image (e.g., those subpixels correspond to an edge or boundary in the image).

Accordingly, the data converter 110 may generate adapted data by applying the rendering filter only to the subpixel (or subpixels) at the boundary part detected by the boundary detection unit according to a setting.

Further, the data converter 110 may generate the adapted data by applying the rendering filter to the entire input data regardless of the configuration of the boundary detection unit.

The timing controller 120 receives the adapted data from the data converter 110. The data converter 110 may be integrally formed with the timing controller 120. The data converter 110 may be embedded in the timing controller 120.

The timing controller 120 supplies the adapted data and other control signals to the data driver 130.

The data driver 130 may include at least one source drive IC or source drive integrated circuit (not illustrated). The source drive IC receives the adapted data and other control signals from the timing controller 120. The source driver IC generates an image signal by converting the adapted data into a gamma compensation voltage in response to a source timing control signal from the timing controller 120. The image signal is applied to a data electrode.

The gate driver 140 may include a gate shift register (not illustrated). The gate shift register may apply a scan signal to a gate electrode according to a control signal of the timing controller 120.

Figure 2:
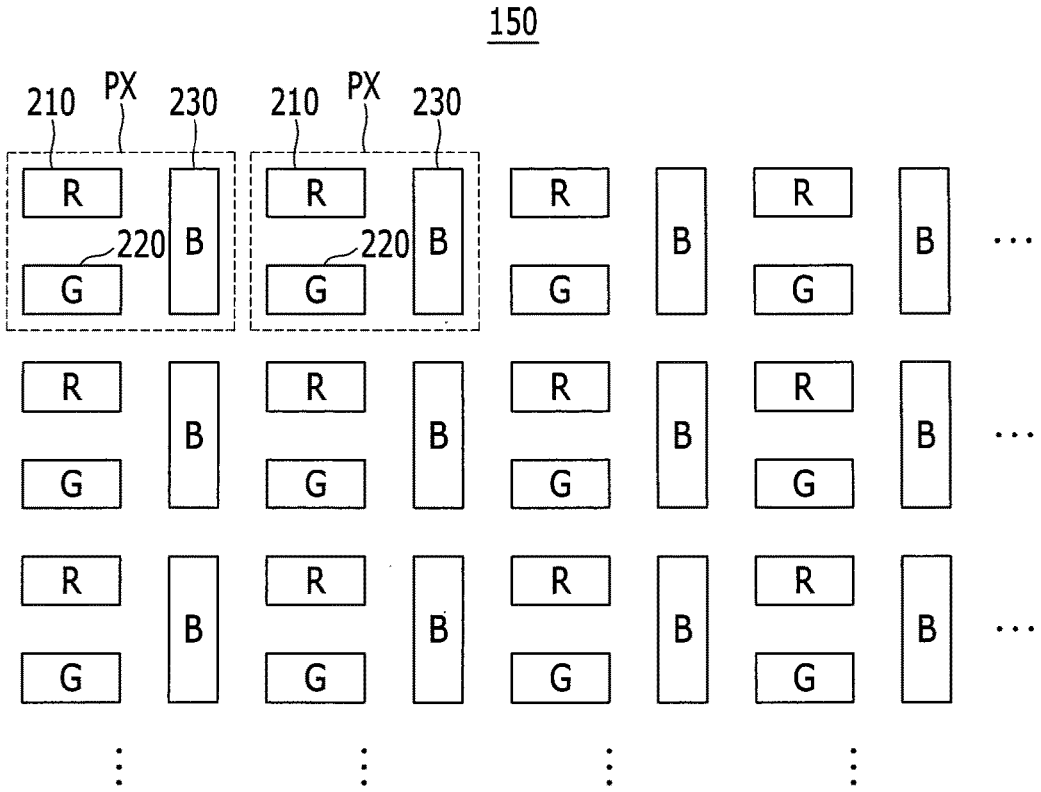
FIG. 2 is a diagram illustrating a part of a display unit in which pixels are arranged by an S-stripe form.

FIG. 2 is a diagram illustrating a part of the display unit 150 in which the pixels are arranged in an S-stripe form (or S-stripe arrangement).

A subpixel disposed at a left upper end of the pixel PX may be referred to as a first color subpixel 210. Further, a subpixel disposed at a left lower end of the pixel PX may be referred to as a second color subpixel 220, and a subpixel disposed at a right side of the pixel PX may be referred to as a third color subpixel 230.

Figure 7:
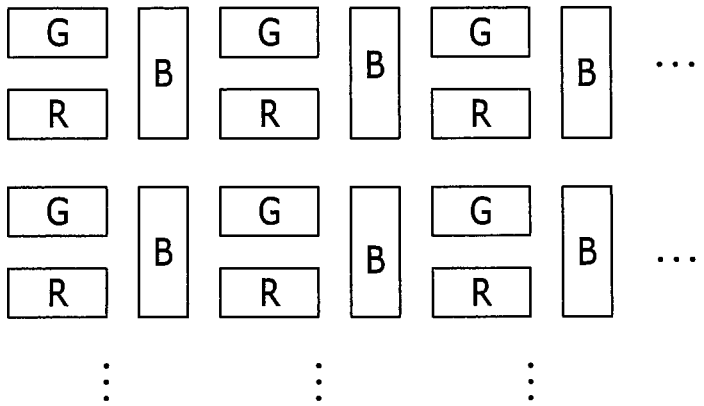
FIG. 7 depicts diagrams for describing a rendering filter according to one embodiment of the present invention applied in a second S-stripe form in which an arrangement of subpixels is changed.
Figure 8:
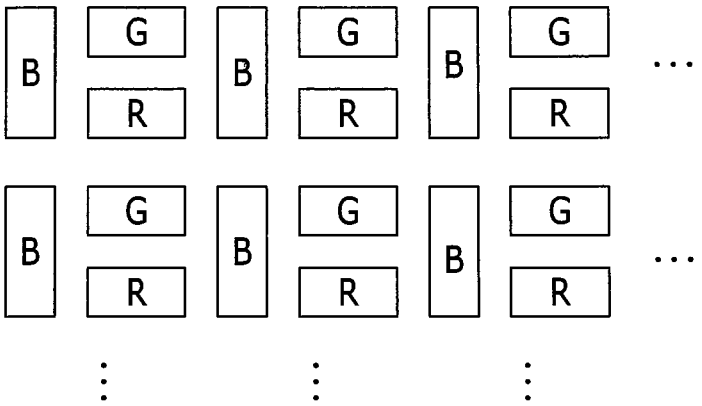
FIG. 8 depicts diagrams for describing a rendering filter according to one embodiment of the present invention applied in a third S-stripe form in which an arrangement of subpixels is changed.

In the exemplary embodiment shown in FIG. 2, the first color corresponds to red, the second color corresponds to green, and the third color corresponds to blue. The colors corresponding to the subpixels may be changed according to the configuration of the display unit 150, one exemplary embodiment of which is shown in FIG. 7, and an arrangement of the subpixels may be changed, one exemplary embodiment of which is shown in FIG. 8.

When a display panel is fabricated in the S-stripe form (or S-stripe arrangement), it is possible to easily adjust an interval between the pixels.

Figure 3:
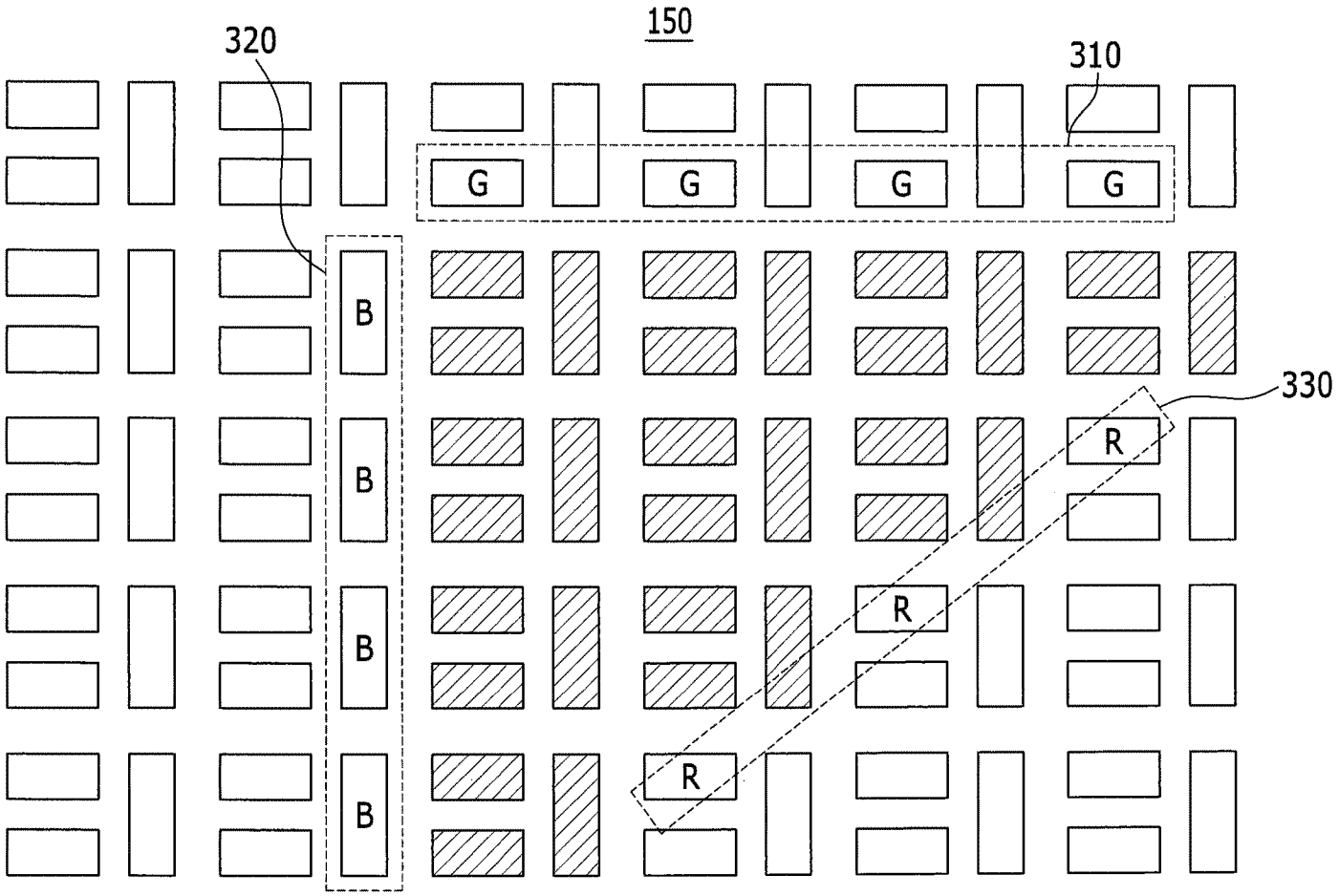
FIG. 3 is a diagram illustrating a color bleeding phenomenon in the S-stripe form.

FIG. 3 is a diagram illustrating a color bleeding phenomenon in the S-stripe form.

Referring to FIG. 3, the subpixels within areas 310, 320, and 330 are in a non-emission state, and the subpixels in the other areas are in an emission state. Accordingly, the image display device in the exemplary embodiment of FIG. 3 displays a black triangular image on a white background.

In this case, the green subpixels having high luminance are concentrated in the area 310, so that a green color bleeding phenomenon occurs (or is incurred). Further, a blue color bleeding phenomenon may occur in the area 320, and a red color bleeding phenomenon may occur in the area 330.

In the exemplary embodiment of FIG. 3, only a black boundary is illustrated, but when a gray level (or gray value) is considerably (or significantly) different between the adjacent pixels, a color bleeding phenomenon may also occur.

Figure 4:
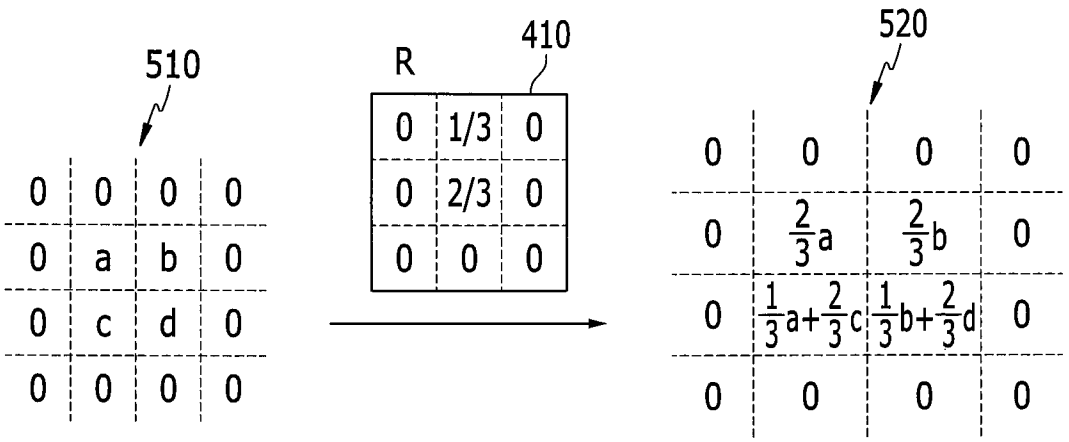
FIG. 4 is a diagram for describing an exemplary embodiment in which a rendering filter is applied to a first color subpixel at a left upper end by the S-stripe form.

FIG. 4 is a diagram for describing an exemplary embodiment in which the rendering filter is applied to the first color subpixel at the left upper end by the S-stripe form.

As described above, in the S-stripe form, a color bleeding phenomenon may occur at a boundary part of the images, at which gray levels (or gray values) are considerably different. In embodiments of the present invention, in order to decrease (or mitigate) the color bleeding phenomenon, a rendering algorithm is applied through the data converter 110.

In some embodiments of the present invention, the rendering filter is independently applied to each color. A rendering filter (or first rendering filter) 410 of FIG. 4 is applied only to data corresponding to the first color subpixel 210 disposed at the left upper end. That is, the data corresponding to the second color subpixel 220 and the third color subpixel 230 is not related to the rendering filter 410 of FIG. 4.

A rendering filter or second rendering filter 420, which is to be described below, is applied to the data corresponding to the second color subpixel 220, and a rendering filter or third rendering filter 430, which is to be described below, is applied to the data corresponding to the third color subpixel 230.

The rendering algorithm is applied between the input data and the adapted data by using the rendering filter in the matrix form.

The input data may include unit input data of the first color, the second color, and the third color. The input data may further include other data (for example, metadata). Each unit input data corresponds to each subpixel (e.g., a gray level or gray value for a corresponding subpixel during one frame).

The adapted data may include unit adapted data of the first color, the second color, and the third color. The adapted data may further include other data. Each unit adapted data corresponds to each subpixel (e.g., an adapted gray level or adapted gray value for a corresponding subpixel during one frame).

The unit input data of the first color of the input data is related to the unit input data of the first color of the adapted data. Further, the unit input data of the second color of the input data is related to the unit input data of the second color of the adapted data, and the unit input data of the third color of the input data is related to the unit input data of the third color of the adapted data.

However, the rendering filter according to the exemplary embodiment of the present invention is applied at a luminance level, not a gray level. This results from a linear characteristic of a luminance level.

For reference, a relationship between luminance and a gray level is expressed by Equation 1 below.

$$\text{Luminance} \propto (\text{gray level})^{gamma} \qquad \text{Equation 1}$$

The input data is data of a gray level. Accordingly, after the gray level is changed to a luminance level by applying a gamma value, the rendering filter is applied. When the rendering filter is applied, the luminance level is changed to the gray level according to the gamma value again to generate adapted data.

FIG. 4 illustratively illustrates an arrangement of luminance values of the first color subpixels 210 that make up a part of the display unit 150. An arrangement 510 is an arrangement of luminance values before the application of the rendering filter 410, and an arrangement 520 is an arrangement of luminance values after the application of the rendering filter 410.

The rendering filter or first rendering filter 410 is multiplied with every first color subpixel 210. Referring to coefficients of the rendering filter 410, it can be seen that a luminance value of each first color subpixel 210 (e.g., the center pixel in the rendering filter 410) is multiplied by coefficient ⅔, and a luminance value of the first color subpixel 210 right above (e.g., directly above) each first color subpixel 210 is multiplied by coefficient ⅓, and the two values obtained by the multiplication are summed.

In this case, the first color subpixel 210 multiplied by coefficient ⅔ may be referred to as a target subpixel. Further, the first color subpixel 210 multiplied by coefficient ⅓ may be referred to as another subpixel adjacent to the target subpixel along a specific direction. In this case, the specific direction is an up direction.

In the exemplary embodiment of FIG. 4, only one type of rendering filter 410 is suggested, but those skilled in the art can change the coefficient of the rendering filter 410 according to usage or circumstances.

For example, a coefficient of the second row and the second column of the rendering filter 410 may be any one of real numbers between ½ and ¾, rather than ⅔. In this case, a coefficient of the first row and the second column of the rendering filter 410 may be any one of real numbers between ¼ and ½, rather than ⅓.

In this case, a sum of the coefficient of the second row and the second column and the coefficient of the first row and the second column may be 1.

In FIG. 4, the rendering filter has been described based on the luminance level for the sake of convenience, but the rendering filter may be described based on the gray level.

When a gray level (or gray value) of the first unit input data corresponding to the corresponding first color subpixel 210 is Ri1, a gray level (or gray value) of the second unit input data corresponding to the first color subpixel right above the corresponding first color subpixel 210 is Ri2, a gray level (or gray value) of the unit adapted data corresponding to the corresponding first color subpixel 210 is Ro, and a gamma value is 2.2, Equation 2 below may be satisfied.

$$Ro = \left(\frac{2}{3} * Ri1^{2.2} + \frac{1}{3} * Ri2^{2.2}\right)^{\frac{1}{2.2}} \quad \text{Equation 2}$$

Figure 5:
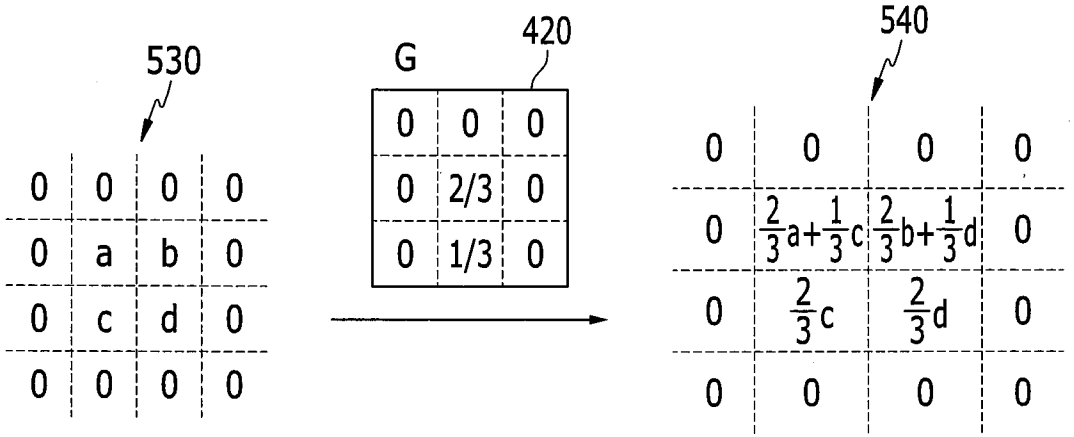
FIG. 5 is a diagram for describing an exemplary embodiment in which a rendering filter is applied to a second color subpixel at a left lower end by the S-stripe form.

FIG. 5 is a diagram for describing an exemplary embodiment in which the rendering filter is applied to the second color subpixel at the left lower end by the S-stripe form.

FIG. 5 illustratively illustrates an arrangement of luminance values of the second color subpixels 220 configuring a part of the display unit 150. An arrangement 530 is an arrangement of luminance values before the application of the rendering filter or second rendering filter 420, and an arrangement 540 is an arrangement of luminance values after the application of the rendering filter 420.

The rendering filter or second rendering filter 420 is multiplied with every second color subpixel 220. Referring to coefficients of the rendering filter 420, it can be seen that a luminance value of each second color subpixel 220 is multiplied by coefficient ⅔, and a luminance value of the second color subpixel 220 right under (e.g., directly below) each second color subpixel 220 is multiplied by coefficient ⅓, and the two values obtained by the multiplication are summed.

In this case, the second color subpixel 220 multiplied by coefficient ⅔ may be referred to as a target subpixel. Further, the second subpixel 220 multiplied by coefficient ⅓ may be referred to as another subpixel adjacent to the target subpixel along a specific direction. In this case, the specific direction is a down direction.

In the exemplary embodiment of FIG. 5, only one type of rendering filter 420 is suggested, but those skilled in the art can change the coefficient of the rendering filter 420 according to usage.

For example, a coefficient of the second row and the second column of the rendering filter 420 may be any one of real numbers between ½ and ¾, rather than ⅔. In this case, a coefficient of the third row and the second column of the rendering filter 420 may be any one of real numbers between ¼ and ½, rather than ⅓.

In this case, a sum of the coefficient of the second row and the second column and the coefficient of the third row and the second column may be 1.

In FIG. 5, the rendering filter has been described based on the luminance level for the sake of convenience, but the rendering filter may be described based on the gray level.

When a gray level (or gray value) of the first unit input data corresponding to the corresponding second color subpixel 220 is Gi1, a gray level (or gray value) of the second unit input data corresponding to the second color subpixel 220 right under the corresponding second color subpixel 220 is Gi2, a gray level (or gray value) of the unit adapted data corresponding to the corresponding second color subpixel 220 is Go, and a gamma value is 2.2, Equation 3 below may be satisfied.

$$Go = \left(\frac{2}{3} * Gi1^{2.2} + \frac{1}{3} * Gi2^{2.2}\right)^{\frac{1}{2.2}} \quad \text{Equation 3}$$

Figure 6:
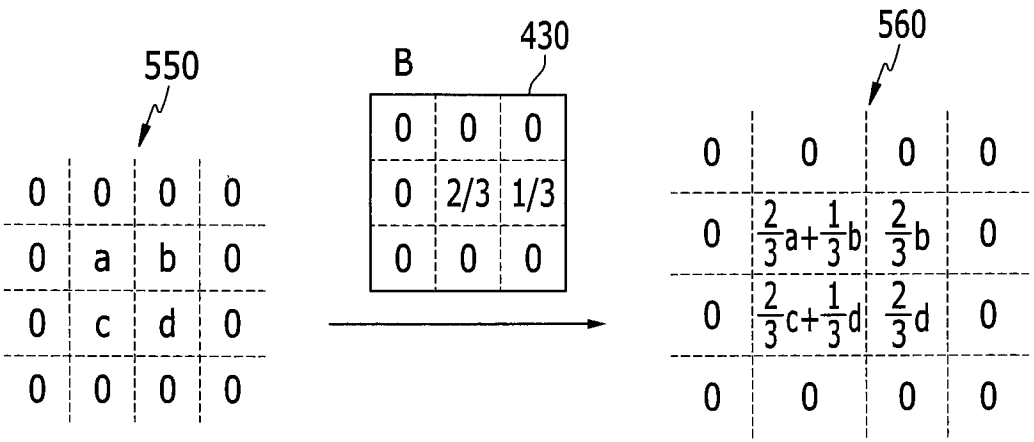
FIG. 6 is a diagram for describing an exemplary embodiment in which a rendering filter is applied to a third color subpixel at a right side by the S-stripe form.

FIG. 6 is a diagram for describing an exemplary embodiment in which a rendering filter is applied to the third color subpixel at the right side by the S-stripe form.

FIG. 6 illustratively illustrates an arrangement of luminance values of the third color subpixels 230 configuring a part of the display unit 150. An arrangement 550 is an arrangement of luminance values before the application of the rendering filter or third rendering filter 430, and an arrangement 560 is an arrangement of luminance values after the application of the rendering filter 430.

The rendering filter or third rendering filter 430 is multiplied with every third color subpixel 230. Referring to coefficients of the rendering filter 430, it can be seen that a luminance value of each third color subpixel 230 is multiplied by coefficient ⅔, and a luminance value of the third color subpixel 230 at a right left side of each third color subpixel 230 is multiplied by coefficient ⅓, and the two values obtained by the multiplication are summed.

In this case, the third color subpixel 230 multiplied by coefficient ⅔ may be referred to as a target subpixel. Further, the third color subpixel 230 multiplied by coefficient ⅓ may be referred to as another subpixel adjacent to the target subpixel in a specific direction. In this case, the specific direction is a right direction.

In the exemplary embodiment of FIG. 6, only one type of rendering filter 430 is suggested, but it is obvious that those skilled in the art can change coefficient of the rendering filter 430 according to usage.

For example, a coefficient of the second row and the second column of the rendering filter 430 may be any one of real numbers between ½ and ¾, rather than ⅔. In this case, a coefficient of the second row and the third column of the rendering filter 430 may be any one of real numbers between ¼ and ½, rather than ⅓.

In this case, a sum of the coefficient of the second row and the second column and the coefficient of the second row and the third column may be 1.

In FIG. 6, the rendering filter has been described based on the luminance level for the sake of convenience, but the rendering filter may be described based on the gray level.

When a gray level (or gray value) of the first unit input data corresponding to the corresponding third color subpixel 230 is Bi1, a gray level (or gray value) of the second unit input data corresponding to the third color subpixel 230 right at the right side (or directly to the right) of the corresponding third color subpixel 230 is Bi2, a gray level (or gray value) of the unit adapted data corresponding to the corresponding third color subpixel 230 is Bo, and a gamma value is 2.2, Equation 4 below may be satisfied.

$$Bo = \left(\frac{2}{3} * Bi1^{2.2} + \frac{1}{3} * Bi2^{2.2}\right)^{\frac{1}{2.2}} \quad \text{Equation 4}$$

It is possible to considerably decrease a color bleeding phenomenon of FIG. 3 by selectively applying the aforementioned rendering filters, exemplary embodiments of which are shown in FIGS. 4, 5, and 6.

FIG. 7 is a diagram for describing a rendering filter applied in a second S-stripe form in which an arrangement of subpixels is changed.

Referring to part (a) of FIG. 7, in the exemplary embodiment of FIG. 7, a first color is green and a second color is red.

Referring to part (b) of FIG. 7, it can be seen that the red rendering filter and the green rendering filter are changed, compared to the aforementioned exemplary embodiment.

FIG. 8 depicts diagrams for describing a rendering filter applied in a third S-stripe form in which an arrangement of subpixels is changed.

Referring to parts (a) and (b) of FIG. 8, it can be seen that the third color subpixel 230 of FIG. 2 is changed to be positioned at the left side of the pixel PX. Further, a first color is green and a second color is red.

It can be seen from FIGS. 7 and 8 that the rendering filter of the present invention is not essentially applied to the S-stripe form of FIG. 2, but may be variously modified.

Figure 9:
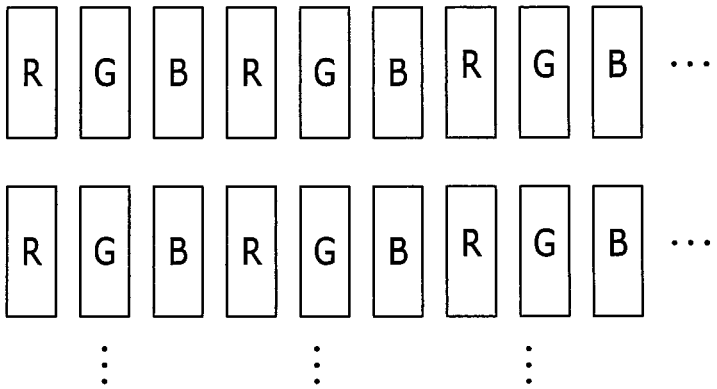
FIG. 9 depicts diagrams for describing an exemplary embodiment in which a rendering method of the present invention is applied in an RGB stripe scheme.

FIG. 9 depicts diagrams for describing an exemplary embodiment in which a rendering method of the present invention is applied in an RGB stripe scheme.

Part (a) of FIG. 9 illustrates the display unit 150 in which the pixels are arranged in an RGB stripe scheme.

Although the arrangement scheme is not the S-stripe form, the concept of the present invention is applicable. A color bleeding phenomenon may occur even in the RGB stripe scheme.

In this case, the color bleeding phenomenon may be solved by applying the rendering filter of part (b) of FIG. 9.

In the RGB stripe structure, the green is positioned at the center, so that the green is sufficiently mixed, and therefore does not contribute to the color bleeding phenomenon.

However, the color bleeding phenomenon of red and blue is considerably exhibited, so that the rendering filter may be applied to each of the red subpixel and the blue subpixel.

A detailed description of the accompanying drawings and the invention are only illustrative, which are used for the purpose of describing the present invention but are not used to limit the meanings or a range of the present invention described in claims. Therefore, it is understood that various modifications and the equivalent other exemplary embodiments may be possible by those who are skilled in the art. Accordingly, the technical protection range of the present invention may depend on the technical spirit of the accompanying claims.

DESCRIPTION OF SYMBOLS

110: Data converter
120: Timing controller
130: Data driver
140: Gate driver
150: Display unit
210: First color subpixel
220: Second color subpixel
230: Third color subpixel

What is claimed is:

1. A display device, comprising:

a display unit comprising a plurality of pixels that are contiguously arranged, each of the pixels comprising a first color subpixel at a left upper end, a second color subpixel at a left lower end, and a third color subpixel at a right side, which are arranged in an S-stripe form;

a data converter configured to convert first color, second color, and third color unit input data portions of input data into first color, second color, and third color unit adapted data; and a driver configured to apply an image signal to the pixel based on the adapted data, wherein the data converter is configured to generate unit adapted data in accordance with first unit input data corresponding to a target subpixel and second unit input data corresponding to another subpixel adjacent to the target subpixel along a specific direction, the specific direction being:

an up direction when the target subpixel is the first color subpixel;

a down direction when the target subpixel is the second color subpixel; and a right direction when the target subpixel is the third color subpixel.

2. The display device of claim 1, wherein:

when a value of the first unit input data is Di1, a value of the second unit input data is Di2, and a value of the unit adapted data is Do, an equation below is satisfied, $$Do=a*Di1+(1-a)*Di2$$

in this case, Di1, Di2, and Do are data values of a luminance level, and a is a real number within a range of $\frac{1}{2}<a<\frac{3}{4}$.

3. The display device of claim 2, wherein:

a is $\frac{2}{3}$.

4. The display device of claim 1, wherein:

the data converter is configured to apply a rendering filter having a matrix equation as shown below to convert data corresponding to the first color subpixel, $$\begin{bmatrix} 0 & 1/3 & 0 \\ 0 & 2/3 & 0 \\ 0 & 0 & 0 \end{bmatrix}$$

a rendering filter having a matrix equation as shown below to convert data corresponding to the second color subpixel, and $$\begin{bmatrix} 0 & 0 & 0 \\ 0 & 2/3 & 0 \\ 0 & 1/3 & 0 \end{bmatrix}$$

a rendering filter having a matrix equation as shown below to convert data corresponding to the third color subpixel $$\begin{bmatrix} 0 & 0 & 0 \\ 0 & 2/3 & 1/3 \\ 0 & 0 & 0 \end{bmatrix}.$$

5. The display device of claim 1, further comprising:

a boundary detection unit, wherein when a difference between values of the unit input data corresponding to the plurality of adjacent subpixels is greater than or equal to a threshold value, the boundary detection unit detects the plurality of adjacent subpixels as a boundary part of an image, and wherein the data converter is configured to convert only the input data corresponding to the boundary part into the adapted data.

* * * * *